United States Patent [19]

Badillo

[11] Patent Number: 4,858,543

[45] Date of Patent: Aug. 22, 1989

[54] PLASTIC BOBBIN BASKET WITH NEEDLE GUARD PLATE

[75] Inventor: Paul Badillo, Lakewood, Colo.

[73] Assignee: Bakron Corp., Morton Grove, Ill.

[21] Appl. No.: 165,260

[22] Filed: Mar. 7, 1988

[51] Int. Cl.[4] ..... D05B 57/26

[52] U.S. Cl. ..... 112/231

[58] Field of Search ..... 112/230, 231, 228, 261, 112/227, 181, 182, 260

[56] References Cited

U.S. PATENT DOCUMENTS

| | | | |
|---|---|---|---|
| 2,857,869 | 10/1958 | Odermann | 112/228 |
| 2,866,425 | 12/1958 | Palmbach | 112/182 |
| 3,955,519 | 5/1976 | Weisz | 112/228 |
| 4,108,095 | 8/1978 | Kohara | 112/230 X |
| 4,278,038 | 7/1981 | Johnson | 112/228 |
| 4,377,121 | 3/1983 | Teranishi | 112/231 |
| 4,700,643 | 10/1987 | Hirose et al. | 112/231 |

FOREIGN PATENT DOCUMENTS

| | | | |
|---|---|---|---|
| 60-261490 | 12/1985 | Japan | 112/228 |
| 728247 | 4/1955 | United Kingdom | 112/231 |

*Primary Examiner*—Andrew M. Falik

*Attorney, Agent, or Firm*—Clement and Ryan

[57] ABSTRACT

A horizontal lock-stitch bobbin basket includes a cylindrical side wall, a laterally extending flange formed at the top of the side wall, and a rotation restraining notch formed in the top face of the flange. An elongated bore is defined by the side wall adjacent the restraining notch to provide for needle clearance. The bobbin basket is made of plastic and includes a needle guarding member the (1) protects the area of the bobbin basket adjacent to the bore from being accidentally damaged by the needle of a sewing machine, and (2) deflects the needle into the elongated bore.

11 Claims, 3 Drawing Sheets

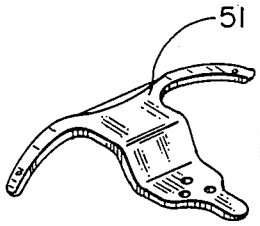
FIG. 4a
FIG. 4b
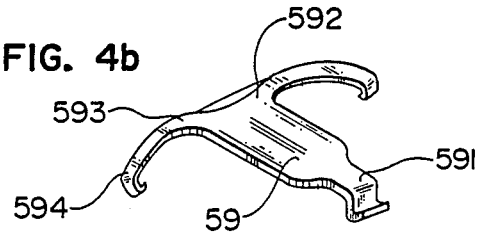
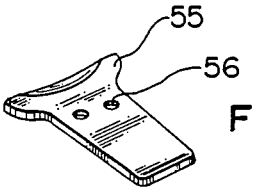
FIG. 4c
FIG. 4d
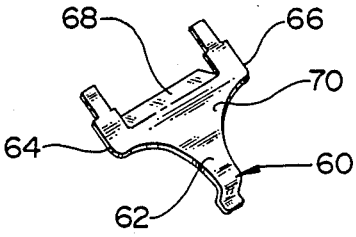
FIG. 5
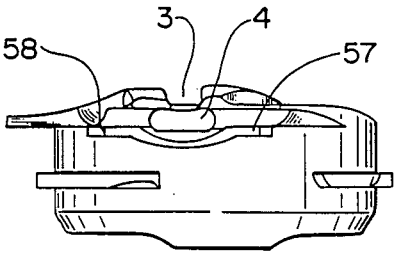

PLASTIC BOBBIN BASKET WITH NEEDLE GUARD PLATE

BACKGROUND OF THE INVENTION

The present invention relates to a bobbin basket for a sewing machine, and more particularly, to a horizontal lock-stitch bobbin basket.

Known bobbin baskets for sewing machines are made of steel or the like. Such baskets, however, have disadvantages such as:

Generally, there is provided a peripheral bearing rib on the outer surface of the cylindrical side wall of the bobbin basket. For journalling the bobbin basket within the raceway of a rotary hook assembly, the cooperation of the raceway and the rib needs to be oiled to secure a smooth rotation therebetween. Unfortunately, it is unavoidable that the thread, and thus in turn the cloth to be sewn, will be contaminated by the lubricating oil between the raceway and the bearing rib.

Owing to needle fragments that fall between the rotary hook and the bearing rib of the bobbin basket and to the resulting wear occurring therebetween, or to occasional vibration, leading parts of the bearing rib and the raceway will become chipped. When the chipped areas grow to any substantial extent, non-alignment between the bobbin basket and the rotary hook will cause thread breaking.

Furthermore, an all steel hook assembly by comparison wears out sooner than an assembly using a plastic bobbin basket. The life of a steel bobbin basket is about three times shorter than a plastic one because of the heat generated in the steel assembly.

Moreover, the steel costs are higher than the plastic. The cost of manufacturing a plastic bobbin basket is about one-fourth of that of a steel one.

In addition, the bearing rib of the steel bobbin basket and the raceway of the rotary hook will exhibit greater wear than an assembly using a plastic bobbin basket will exhibit, since the steel bobbin basket is heavier and the coefficient of friction between the rib of the steel bobbin basket and the steel raceway of the rotary hook is larger than that for an assembly using a plastic bobbin basket. The worn rib and raceway will cause unbalance in the assembly, thereby interfering with correct release of the needle thread.

The applicant has sought to overcome the above encountered by the prior art.

SUMMARY OF THE INVENTION

It is therefore an object of the present invention to provide a bobbin basket in which lubricating oil need not be present between the raceway of the rotary hook and the rib of the bobbin basket.

It is a further object of the present invention to provide a bobbin basket where the leading part of the raceway of the rotary hook will not be chipped even if occasional vibration occurs.

It is an additional object of the present invention to provide a bobbin basket having a prolonged life.

It is still another object of the present invention to provide a bobbin basket having a reduced cost.

It is yet an object of the present invention to provide a bobbin basket, such that the rib of the bobbin basket and the raceway of the rotary hook will not wear easily.

It is another object of the present invention to provide a bobbin basket whose central stud will not break easily when there is a thread jamming or a screwdriver is inserted to clear the basket from a mass of thread tangled therein because the plastic basket and stud will flex somewhat.

A preferred embodiment of a horizontal lock-stitch bobbin basket according to a present invention includes a cylindrical side wall, a laterally extending flange formed at the top of the side wall, a rotation restraining notch formed in the top face of the flange and an elongated bore in the flange located between the side wall and the restraining notch of the flange to provide for needle clearance, wherein the improvement resides in that the bobbin basket is made of plastic and is provided with a needle deflection plate.

Preferably, the bobbin basket according to the present invention further includes a needle guarding means or deflection plate located adjacent to the elongated bore and secured to the body of the bobbin basket so that if the needle of a sewing machine incorporating the bobbin basket does not directly penetrate into the bore but strikes the area of the bobbin basket adjacent to the bore, the needle guarding means will protect the area of the bobbin basket adjacent to the bore from being damaged by the needle and guide the needle into the bore.

The needle guarding means can be a plate, formed of a suitable impact-resistant material, partly embedded in the body of the bobbin basket and having two arms fixed to the body in order to better secure the plate to the body.

The needle guarding means can also be a plate having a first barbed end and a second end with two protruding arms, the free ends of which are barbed so that the first barbed end and the barbed ends of the two arms can snap fit in corresponding holes provided on the body.

Alternatively, the needle guarding means can be a plate having a plurality of rivet holes in order that the plate can be riveted together with the body.

Also, the needle guarding means can alternatively be a strip-like member fixed to the body of the bobbin basket.

Preferably, the bobbin basket according to the present invention further includes a bobbin case aligning part formed on the vertical surface of the side wall for aligning and positioning a bobbin case in the bobbin basket and for thickening the region where the needle guarding means is secured to the body of the bobbin basket. If desired, this aligning part can be integrally formed to the body.

The present invention may best be understood with reference to the accompanying drawings, in which:

BRIEF DESCRIPTION OF THE DRAWINGS

FIG. 4A is a perspective view showing a first embodiment of a needle guarding means according to the present invention;

FIG. 4B is a perspective view showing a second embodiment of a needle guarding means according to the present invention;

FIG. 4C is a perspective view showing a third embodiment of a needle guarding means according to the present invention;

FIG. 4D is a perspective view showing another embodiment of a needle guarding means according to the present invention;

FIG. 5 is a side elevation view showing a bobbin basket incorporting yet another embodiment of a needle guarding means according to the present invention;

DETAILED DESCRIPTION OF THE PREFERRED EMBODIMENT

Figure 6:
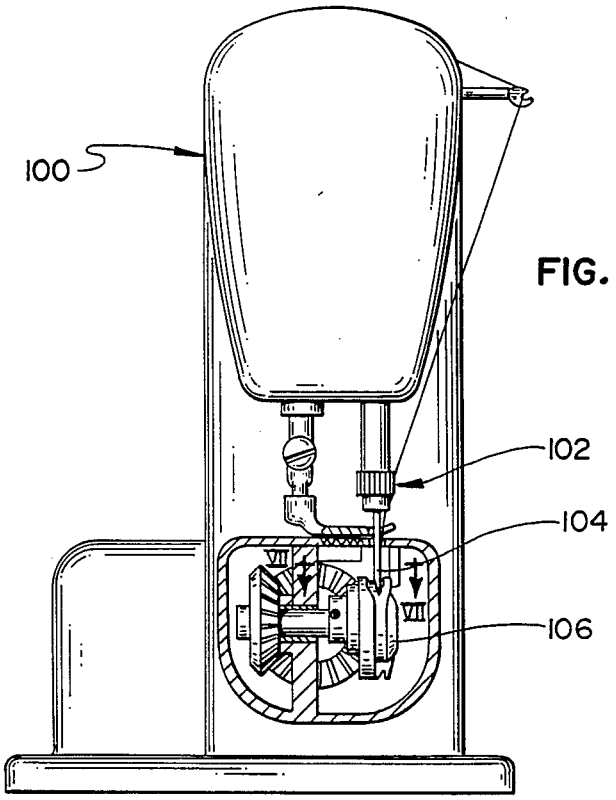
FIG. 6 is a vertical elevational and a partly broken away view of a sewing machine using a horizontal hook assembly and bobbin basket.
Figure 7:
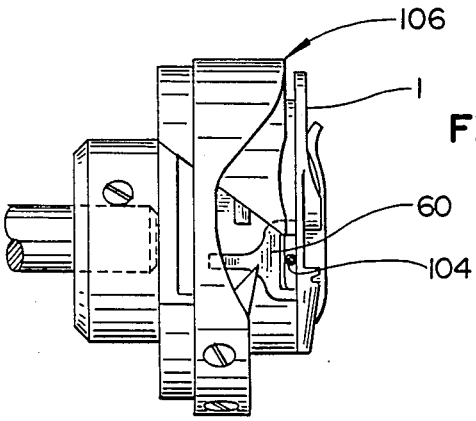
FIG. 7 is an enlarged horizontal view of a hook assembly taken along line 7—7 of FIG. 6.

Referring first to FIG. 6, there is shown a sewing machine 100 which includes a downwardly movable and reciprocating needle assembly 102, a needle 104 and a rotary hook assembly 106 that carries the bobbin thread, bobbin basket case, bobbin basket and rotary hook. The cooperation of the needle 104 and rotary hook assembly is seen in FIG. 7.

Figure 1:
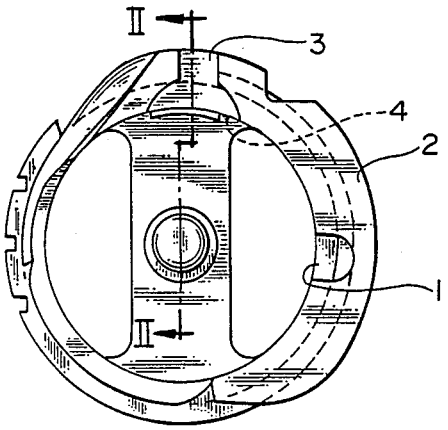
FIG 1 is a top plan view showing a bobbin basket according to a preferred embodiment of the present invention.
Figure 2:
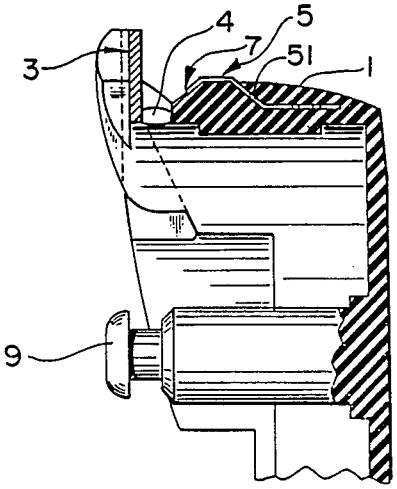
FIG. 2 is an enlarged fragmentary sectional view taken along the line II—II of FIG. 1.
Figure 2A:
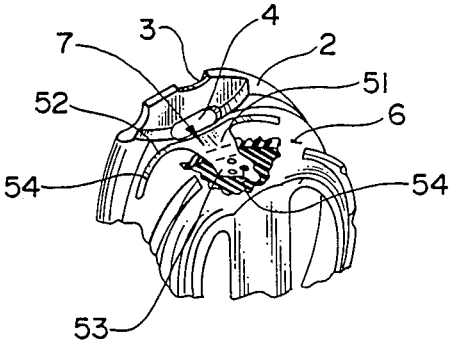
FIG. 2A is a fragmentary perspective view showing the bobbin basket according to the present invention incorporating a needle guarding plate.

Referring now to FIGS. 1–2A, a horizontal, lock-stitch bobbin basket according to the present invention is made of plastic which includes a cylindrical side wall 1, a laterally extending flange 2 on the top of side wall 1, a rotation restraining notch 3 formed in the top face of flange 2 and an elongated bore or opening 4 located in side wall 1 adjacent restraining notch 3 to provide for needle clearance.

The bobbin basket according to the present invention is provided with a needle guarding means or deflection plate 5 located adjacent to elongated bore 4 and secured to the body 6 of the bobbin basket so that when the needle of a sewing machine incorporating the present bobbin basket accidentally does not penetrate or pass into bore 4 but strikes the area 7 of the bobbin basket adjacent to bore 4, needle guarding means 5 will protect area 7 from being damaged by the needle and guide or deflect the needle into bore 4.

As shown in FIGS. 2, 2A and 4A, a first embodiment of needle guarding means 5 according to the present invention, also called a moulded part type, is a plate 51 which is so curved as to be partly embedded in body 6 and has two arms 52 fixed to body 6 in order to better secure plate 51 to body 6. If desired, the portion 53 of plate 51 embedded in body 6 and arms 52 can be provided with a plurality of holes 54 into which the plastic can penetrate during moulding so that plate 51 is better secured to body 6. Any other suitable measure, e.g., protrusions instead of holes 54, can be used to achieve the same effect.

As shown in FIG. 4B, a second embodiment of needle guarding means 5 according to the present invention, also called a snap fit type, is a plate 59 having a first barbed end 591 and a second end 592, protruding two arms 593, the free ends 594 of which are barbed so that first barbed end 591 and barbed ends 594 of arms 593 can snap-fit in corresponding holes (not shown) provided on body 6. Since the snap-fitting technique is well known in the art, the detail of which according to the present invention will not be further described.

As shown in FIG. 4C, a third embodiment of needle guarding means 5 according to the present invention, also called a rivet or screw type, is a plate 55 having a plurality of holes 56 through which a plurality of fastening media, e.g., rivets or screws, can pass in order that plate 55 can be secured to body 6.

As shown in FIG. 4D, another embodiment 60 of the needle guarding means or deflection plate according to the present invention is shown. This is also seen in FIG. 4 and provides protection for a rectangularly-shaped needle opening. The plate 60 is of the snap-fit type and has a Y-like shape. The plate has (1) a body 62, (2) a pair of securing arms 64 and 66, which have reduced ends, (3) an integral but bent deflector plate 68 extending from the bight 70 between the arms, and (4) a bent downwardly extending leg-like snap portion 72 for cooperating with the basket body in holding the guarding means 60 in place about the needle receiving bore in the bobbin basket.

As shown in FIG. 5, a wire type of needle guarding means 5 according to the present invention is shown is a strip-like member 57 fixed to body 6. Member 57 can also be provided with a plurality of holes 58 in order to be better secured to body 6. Plate 51, plate 55 and member 57 can be made of metal, e.g., steel. All of 51, 55 and 57 can be secured to body 6 in any suitable manner other than those described above.

As best seen in FIGS. 4A, 4B, and 4C the needle guarding means preferably is beveled at its top edge adjacent to needle-receiving bore 4, to (1) minimize the impact of the needle on the needle guarding means if the needle is accidentally deflected inward toward the bobbin basket, and (2) provide sufficient space for the proper formation of the needle thread loop.

Figure 3:
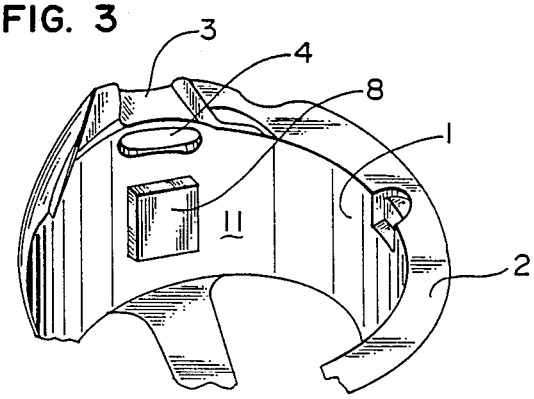
FIG. 3 is a fragmentary perspective view showing an aligning piece included in a bobbin basket according to the present invention.

Generally, the known bobbin basket includes two bobbin case aligning protuberances formed on the inner vertical surface of the cylindrical side wall for aligning and positioning a bobbin case in the bobbin basket. As shown in FIG. 3, a bobbin case aligning piece 8 according to the present invention is formed on the vertical surface 11 of side wall 1 for thickening the region where needle guarding means 5 is secured to body 6 and for aligning and positioning the bobbin case in the basket. If desired, aligning piece 8 can be integrally formed to body 6.

Sometimes it will happen that the steel central stud will break when there is a thread jamming or a screwdriver, or the like, is inserted into the basket to clear the basket from a mass of thread tangled therein. According to the present invention, the central stud 9 (FIG. 2) will not break easily because the plastic will flex.

The plastic material used in the present invention preferably is of a high-wear and self-lubricating type, examples of which are ZYTEL 101 and DELRIN, both marketed by E. I. duPont de Nemours and Company, and ULTEM 4001 by General Electric Company.

While the present invention has been described in connection with preferred embodiments presently contemplated by the Applicant with reference to the accompanying drawings, it is to be noted that the preferred emdodiments described are for purposes of illustration only and not be construed as a limitation of the invention. All such modifications which do not depart from the spirit of the invention are intended to be included within the scope of the appended claims.

What I claim is:

1. A horizontal lock-stitch bobbin basket comprising a cylindrical side wall, a laterally extending flange on the top of said side wall, a rotation restraining notch formed in the top face of said flange, and a needle-receiving opening or bore in said side wall adjacent said restraining notch to provide for needle clearance, characterized in that said bobbin basket including said side wall is integrally formed of plastic and there is provided needle guarding means in the form of a plate positioned adjacent said bore and secured to said basket side wall for protecting said basket side wall from impact in that the needle of a sewing machine incorporating said bobbin basket does not penetrate into said opening but is directed toward the area of said bobbin basket side wall adjacent to said bore, whereby said needle guarding means will protect said area of said bobbin basket sidewall adjacent to said bore from being damaged by said needle and will guide said needle into said bore.

2. A horizontal lock-stitch bobbin basket according to claim 1, wherein said needle guarding means is a plate partly embedded in said side wall and having two arms fixed to said side wall for cooperation in securing said plate to said side wall.

3. A horizontal lock-stitch bobbin basket according to claim 1, wherein said needle guarding means is a Y-shaped plate having a first barbed end and a second end with two protruding arms, the free ends of which are barbed so that said first barbed end and said barbed ends of said two arms can snap-fit in corresponding holes provided on said side wall.

4. A horizontal lock-stitch bobbin basket according to claim 1, wherein said needle guarding means is a plate having a plurality of holes through which a plurality of fastening means can pass in order that said plate can be secured to said side wall.

5. A horizonal lock-stitch bobbin basket according to claim 4, wherein said fastening means are rivets or screws.

6. A horizontal lock-stitch bobbin basket according to claim 1, wherein said needle guarding means is a strip-like member fixed to said side wall.

7. A horizontal lock-stitch bobbin basket according to claim 1, further comprising a bobbin case aligning part formed on the vertical surface of said side wall for aligning and positioning a bobbin case in said bobbin basket and for thickening the region where said needle guarding means is secured to said side wall.

8. A horizontal lock-stitch bobbin basket according to claim 7, wherein said aligning part is integrally formed to said side wall.

9. A horizontal lock-stitch bobbin basket accord according to claim 1, wherein said opening is generally rectangularly shaped and said guarding means is a plate shaped to fit adjacent said opening and snap-fit to said side wall.

10. A horizontal lock-stitch bobbin basket according to claim 9, wherein said plate is generally Y-shaped and including a bight portion having an integral deflector plate extending therefrom and between the arms of the Y-shaped plate.

11. The horizontal lockstitich bobbin basket as in claims 1, 4, 5, 6 or 7 in which the top edge of said guarding means is beveled adjacent said bore, to minimize the impact of the needle of the sewing machine in which said bobbin basket is incorporated, if the needle is accidentally deflected toward the bobbin basket.

* * * * *

UNITED STATES PATENT AND TRADEMARK OFFICE

CERTIFICATE OF CORRECTION

PATENT NO. : 4,858,543

DATED : August 22, 1989

INVENTOR(S) : Paul Badillo

It is certified that error appears in the above-identified patent and that said Letters Patent is hereby corrected as shown below:

Col. 5, line 9, the words -- the event -- should be inserted immediately after "in".

Signed and Sealed this

Third Day of September, 1991

*Attest:*

HARRY F. MANBECK, JR.

*Attesting Officer*

*Commissioner of Patents and Trademarks*